US009618260B2

(12) United States Patent
Kang

(10) Patent No.: US 9,618,260 B2
(45) Date of Patent: Apr. 11, 2017

(54) AIR CONDITIONER

(71) Applicant: LG ELECTRONICS INC., Seoul (KR)

(72) Inventor: Yunjoong Kang, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 121 days.

(21) Appl. No.: 14/332,685

(22) Filed: Jul. 16, 2014

(65) Prior Publication Data

US 2015/0022996 A1 Jan. 22, 2015

(30) Foreign Application Priority Data

Jul. 16, 2013 (KR) ..... 10-2013-0083760

(51) Int. Cl.

| | |
|---|---|
| ***F25D 27/00*** | (2006.01) |
| ***F21V 33/00*** | (2006.01) |
| ***F25D 17/06*** | (2006.01) |
| ***F24F 1/00*** | (2011.01) |
| ***F24F 11/00*** | (2006.01) |
| ***F24F 13/078*** | (2006.01) |

(52) U.S. Cl.

CPC ..... *F25D 27/005* (2013.01); *F21V 33/0092* (2013.01); *F24F 1/0014* (2013.01); *F24F 11/0078* (2013.01); *F24F 11/0086* (2013.01); *F24F 13/078* (2013.01); *F25D 17/06* (2013.01); *F25D 27/00* (2013.01); *F24F 2221/02* (2013.01)

(58) Field of Classification Search

CPC ... F25D 27/005; F21V 33/0092; F24F 1/0014

USPC ..... 428/68

See application file for complete search history.

(56) References Cited

U.S. PATENT DOCUMENTS

| | | | | |
|---|---|---|---|---|
| 2006/0021359 | A1 | 2/2006 | Hur et al. | 62/126 |
| 2012/0087138 | A1 | 4/2012 | Pringle et al. | 362/373 |

FOREIGN PATENT DOCUMENTS

| | | | |
|---|---|---|---|
| CN | 102597642 | 7/2012 | |
| CN | 102829511 | 12/2012 | |
| EP | 2 602 563 A1 | 6/2013 | |
| KR | EP 2602563 A1 * | 6/2013 | F24F 1/0014 |

OTHER PUBLICATIONS

European Search Report issued in application No. 14177289.7 dated Nov. 18, 2014.

Chinese Office Action dated Jul. 28, 2016 (English Translation).

* cited by examiner

*Primary Examiner* — Brent O'Hern

(74) *Attorney, Agent, or Firm* — Ked & Associates LLP

(57) ABSTRACT

An air conditioner is provided. The air conditioner may include an input device that receives an input for setting an operation requirement, a fan that blows air according to the set operation requirement, an illumination system that illuminates a closed curve region, a case having the fan provided therein and at least one air outlet formed therein for discharging air outward from the closed curve, and a lighting controller that controls the illumination system to generate an indicator of a flow direction of air being discharged through the at least one air outlet.

20 Claims, 12 Drawing Sheets

AIR CONDITIONER

CROSS-REFERENCE TO RELATED APPLICATION(S)

This application claims priority under 35 U.S.C. §119 to Korean Application No. 10-2013-0083760 filed in Korea on Jul. 16, 2013, whose entire disclosure is hereby incorporated by reference.

BACKGROUND

1. Field

This relates to an air conditioner, and in particular, to an air conditioner having an illumination system.

2. Background

An air conditioner may discharge cooled or heated air to a room to adjust a room temperature and/or clean the air in the room to provide a more comfortable environment. Such an air conditioner may include an indoor unit having a heat exchanger installed in a room, and an outdoor unit having a compressor, a heat exchanger, and so on for supplying refrigerant to the indoor unit. Such an outdoor unit may be connected to at least one indoor unit, and may supply refrigerant to the at least one indoor unit in response to a requested operation state to operate the air conditioner in a cooling mode or a heating mode as necessary.

An air conditioner installed in a room of a home may occupy space in the room while only fulfilling a function of room cooling or room heating, and thus an actual time period of use of the air conditioner occupying this space within the room may be relatively short compared to other domestic appliances.

BRIEF DESCRIPTION OF THE DRAWINGS

The embodiments will be described in detail with reference to the following drawings in which like reference numerals refer to like elements wherein.

DETAILED DESCRIPTION

Advantages, features and methods of the various embodiments are described herein in detail together with attached drawings. However, embodiments are not limited to the specific embodiments disclosed hereinafter, but may be embodied in different modes. The exemplary embodiments provided herein present disclosure of the various features and scope to persons skilled in this field of art. The same reference numbers will refer to the same elements throughout the specification.

Though terms, such as first and second, may be used for describing different elements, the elements are not limited by such terms. These types of terms are used only for distinguishing one element from another element. For an example, a first contact may instead be referred to as a second contact without departing from the scope as broadly described herein, and, similarly, the second contact may instead be referred to as the first contact, and, though both the first contact and the second contact are contacts, the contacts may not be the same.

Words and terms used in this description describe particular embodiments, but are not intended to limit the embodiments. When used for description, and claims annexed hereto, singular expressions may include plural expressions as far as the singular expression is not obviously singular in view of a context of a passage. A mark may indicate one of the singular expression or the plural expression of the word or both, and vice versa.

The words of "and/or" may refer to one or more than one all possible combinations of cited related items and comprises the items. It is apparent that, though words of "comprises" and/or "comprising" used in this specification designates existence of specified features, integers, steps, operations, elements and/or components, it is further understandable that the words do not exclude existence or addition of one or more than one other feature(s), integer(s), step(s), operation(s), element(s), component(s), and/or group(s) of those.

It may be interpreted that the word of "if" may mean "when" or "upon", or depending on a context, "in response to determining", or "in response to detection". Similarly, a phrase of "if determined" or "if [a specified condition or an event] is detected" may be interpreted that, depending on a context, "upon determining" or "in response to determining" or "upon detection of [a specified condition or an event]".

Hereinafter, computing devices, user interfaces for using such devices, and embodiments of related processes for using the devices may be described.

Figure 1:
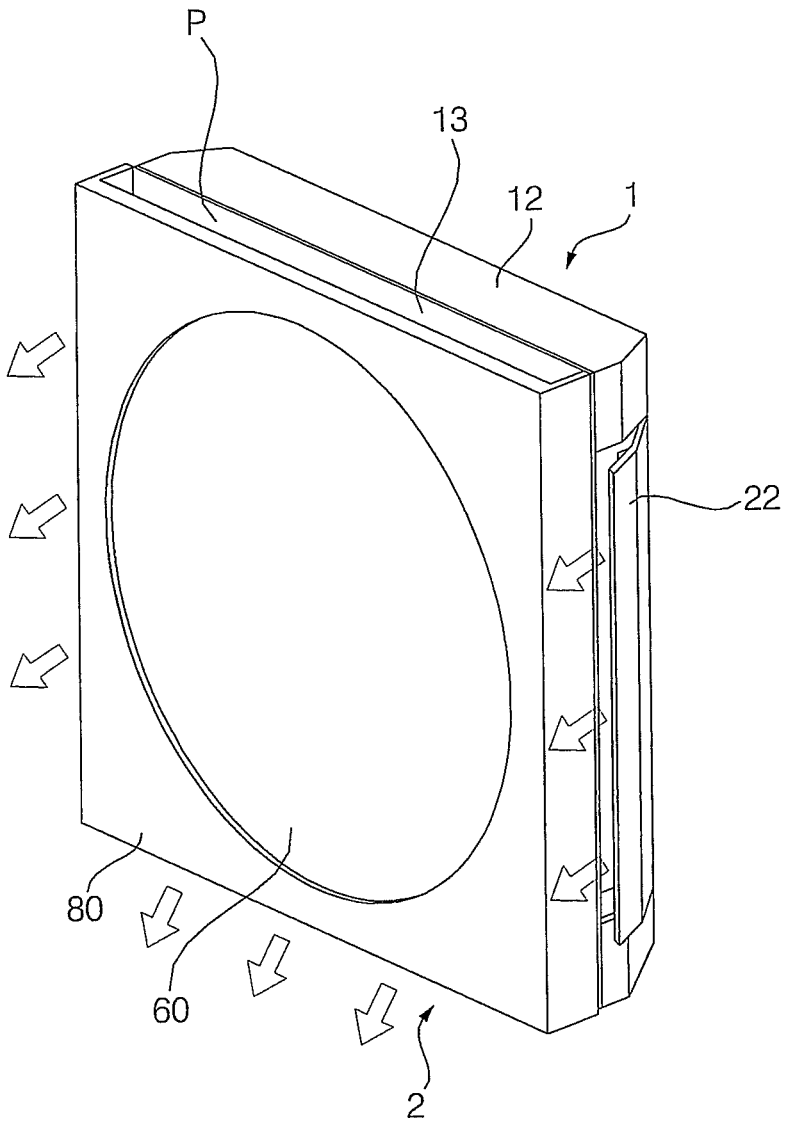
FIG. 1 is a perspective view of an air conditioner, in accordance with an embodiment as broadly described herein, in an operating state.
Figure 2:
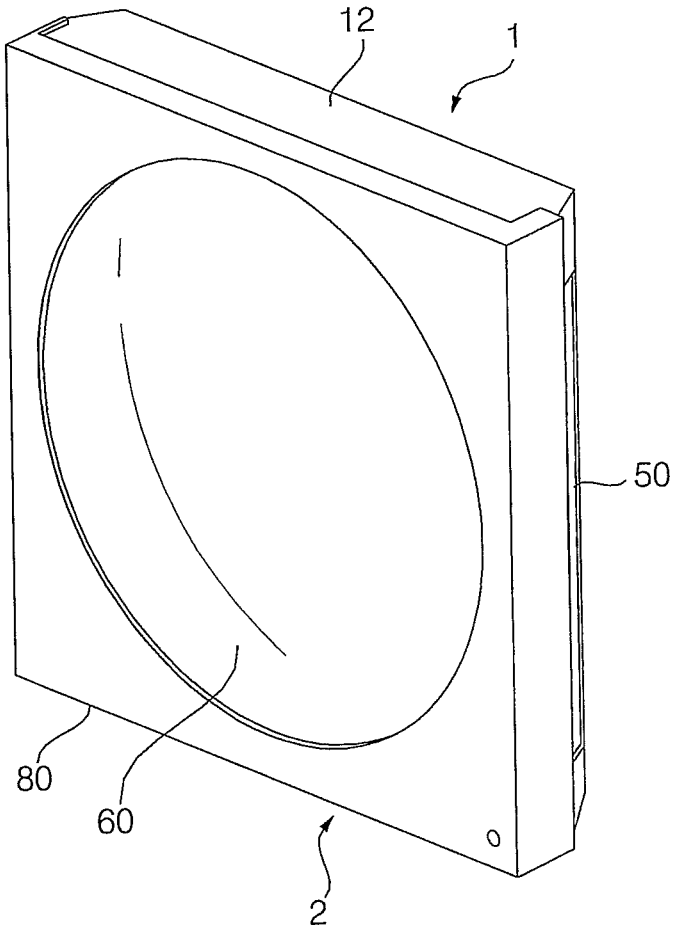
FIG. 2 is a perspective view of an air conditioner, in accordance with an embodiment as broadly described herein, in a stationary state.

Referring to FIGS. 1 and 2, an air conditioner as embodied and broadly described herein may include a body 1 including an air inlet and an air outlet, and an illumination device 2 mounted on the body 1.

Room air may be drawn into the body 1 through the air inlet and discharged from the body 1 through the air outlet. The body 1 may include a plurality of air outlets formed therein. The body 1 may include a rear case 12, and a front case 13 mounted in front of the rear case 12. The rear case 12 and the front case 13 may form an exterior appearance of the body 1.

As shows in the drawings, the illumination device or system 2 may be arranged at a front of the body or case 1 so as to extend from and retract back towards the body 1. The illumination device 2 may retreat in a direction in which the illumination device 2 comes closer to the body 1, and may advance in a direction in which the illumination device 2 moves away from the body 1. When in an advanced position as shown in FIG. 1, the illumination device 2 may form an air inlet passage P with the body 1. In certain embodiments, the air inlet passage P may be formed between the illumination device 2 and the body 1 to be opened in a vertical direction. If the air inlet passage P is opened in the vertical direction, an upper end and a lower end of the air inlet passage P may be opened, to operate in a mode in which the illumination device 2 has an opened upper side, lower side and rear side, and closed front side, left side, and right side. When the illumination device 2 is in an advanced position, the room air may rise from the lower end of the air inlet passage P so as to be drawn into the air inlet passage P, and the room air may move down from the upper end of the air inlet passage P so as to be drawn into the air inlet passage P.

Figure 3:
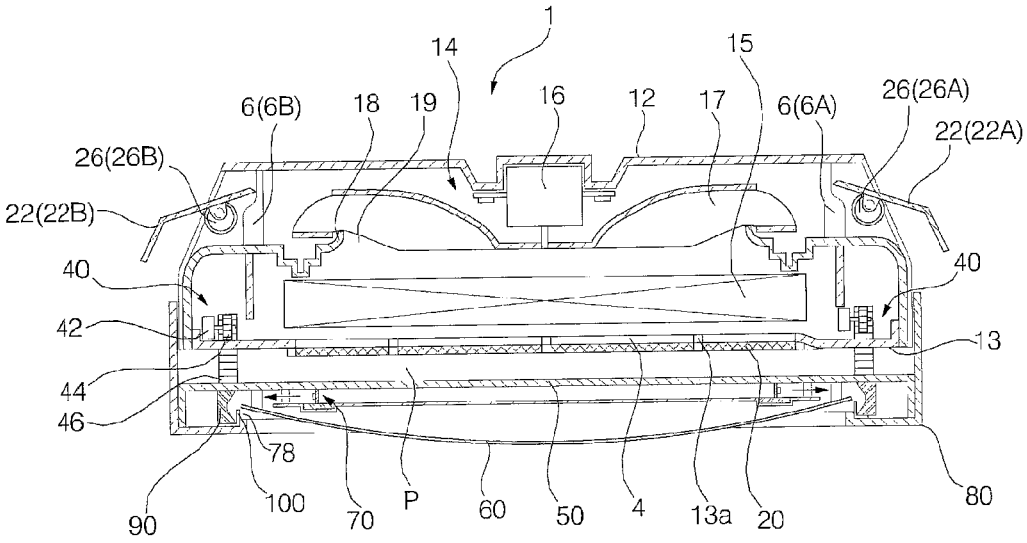
FIG. 3 is a horizontal cross sectional view of an air conditioner, in accordance with an embodiment of as broadly described herein.
Figure 4:
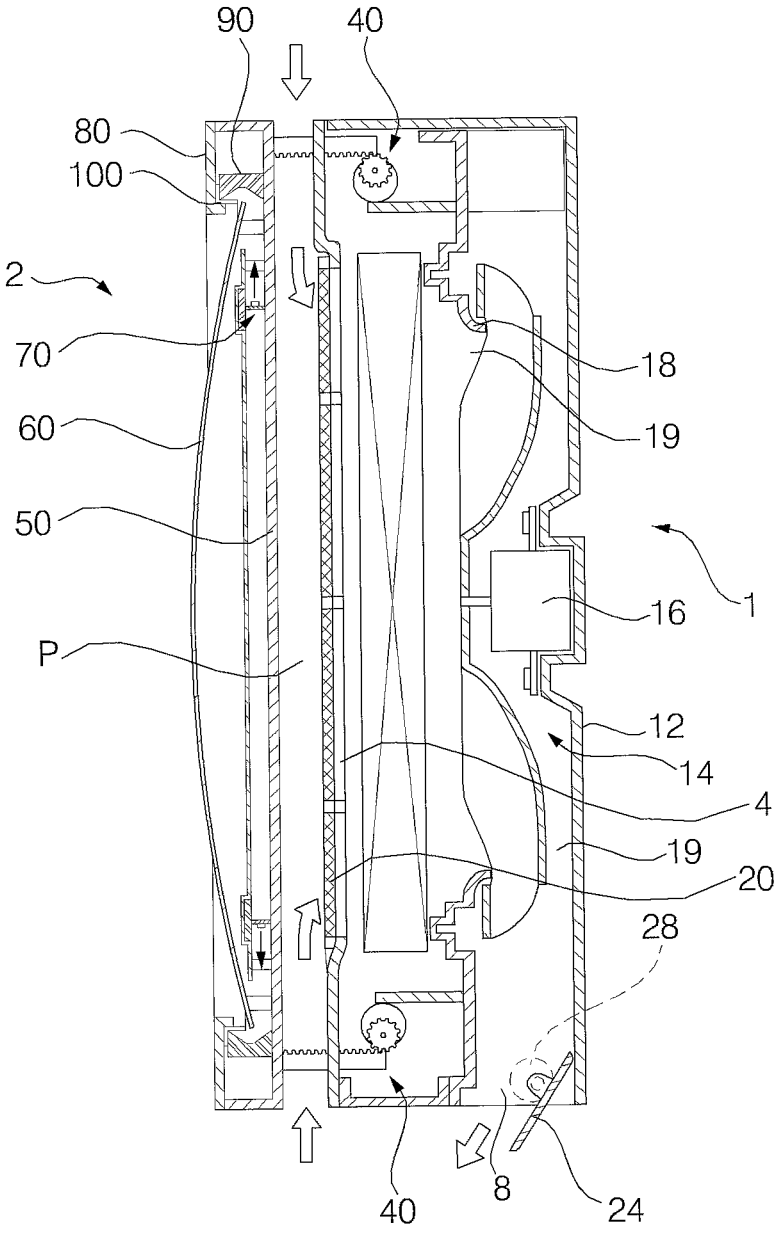
FIG. 4 is a vertical cross sectional view of an air conditioner, in accordance with an embodiment as broadly described herein.

As shown in the horizontal cross sectional view provided in FIG. 3 and the vertical cross sectional view provided in FIG. 4, the body 1 may have the air inlet 4 formed in the front side and a plurality of air outlets 6 and 8 formed therein except for the front side. The plurality of air outlets 6 and 8 discharge the air in directions different from one another. The plurality of air outlets 6 and 8 may be distributed to a plurality of positions of the body 1.

The body 1 may have an air outlet 6 formed in at least one of a left side or a right side of the body 1, and may have a lower side air outlet 8 formed in a lower side. The body 1 may have side air outlets 6 on the left side and the right side of the body 1, respectively.

In certain embodiments, the body 1 may have a left side air outlet 6A formed on the left side, and a right side air outlet 6B formed on the right side. The air conditioned in the body 1 may be distributed in three directions through the left side air outlet 6A, the right side air outlet 6B, and the lower side air outlet 8.

Hereafter, the outlets 6A and 6B will be referred to as the left side air outlet 6A and the right side air outlet 6B, with the left side air outlet 6A and the right side air outlet 6B collectively referred to as the side air outlet 6. Thus, the body or case 1 formed of the rear case 12 and the front case 13 may include the plurality of air outlets 6A, 6B, 8 formed in at least two of the left side, the right side, and the lower side to discharge air indifferent directions from one another, and the air inlet 4 formed in the front side.

The body 1 may have a fan 14 and a heat exchanger 15 mounted therein. The fan 14 and the heat exchanger 15 may be mounted between the rear case 12 and the front case 13.

The rear case 12 may form an air flow passage. The air blown by the fan 14 may flow to the air outlet guided by the rear case 12. The rear case 12 may form a rear exterior of the body 1. The rear case 12 may also form four exterior circumferential sides, upper, lower, left, and right sides, of the body 1. The rear case 12 may form the left side air outlet 6A on the left side, and the right side air outlet 6B on the right side. The left side air outlet 6A may be formed on the left side to be opened in a lateral direction. The right side air outlet 6B may be formed on the right side to be opened in the lateral direction. The rear case 12 may also have the lower side air outlet 8 formed on the lower side. The lower side air outlet 8 may be formed in the lower side of the rear case 12 to be opened in a vertical direction.

The front case 13 may form a front exterior side of the body 1. The front case 13 may have the air inlet 4 formed therein. The air inlet 4 may be formed in the front case 13 to be opened in a front/rear direction. The front case 13 may have a suction grill 13*a* formed thereon for protecting an inside of the body 1. The suction grill 13*a* may be positioned at the air inlet 4. The suction grill 13*a* may be positioned across the air inlet 4.

The fan 14 may draw the air through the air inlet 4, across the heat exchanger 15, and discharge the air through the air outlets 6 and 8. The fan 14 may be a centrifugal type fan which draws the air axially from a front side thereof and blows the air in a radial direction. The fan 14 may include a motor 16 mounted to the rear case 12, and a blower 17 mounted to a rotation shaft of the motor 16. The fan 14 may further include an orifice 18 for guiding the air to the blower 17. The rotation shaft of the motor 16 may extend toward the front. The blower 17 may be a centrifugal fan, such as a turbofan, for drawing the air axially in from the front and blowing the air out the radial direction. The orifice 18 may form a flow passage for the air blown by the blower 17 together with the rear case 12. The rear case 12 may have an air guide formed thereon for guiding the air blown by the blower 17. The rear case 12 may function as a fan housing which surrounds the motor 16 and the blower 17. The orifice 18 may have an air hole 19 formed between the blower 17 and the heat exchanger 15 to guide the air.

The heat exchanger 15 may be mounted to face the air inlet 4. The heat exchanger 15 may be positioned between the front case 13 and the orifice 18. The heat exchanger 15 may be coupled to at least one of the front case 13 or the orifice 18.

The air conditioner may include a filter 20 for cleaning the air being drawn into the air inlet 4. The filter 20 may be mounted to a front side of the front case 13 to be slidably detachable therefrom in the lateral direction. The front case 13 may have a sliding guide formed thereon for guiding lateral direction sliding of the filter 20.

The body 1 may include a side discharge vane 22 for guiding the air being discharged through the side air outlet 6 in a lateral direction of the illumination device 2, and a lower discharge vane 24 for guiding the air being discharged through the lower side air outlet 8.

The side discharge vane 22 may include a left side discharge vane 22A for guiding the air being discharged through the left side air outlet 6A, and a right side discharge vane 22B for guiding the air being discharged through the right side air outlet 6B. The left side discharge vane 22A may be rotatably coupled to the left side of the body 1 to rotate in left/right directions centered on a vertical rotation axis for guiding the air being discharged through the left side air outlet 6A when the left side discharge vane 22A is rotated away from the body 1 in a left side direction. The right side discharge vane 22B may be rotatably coupled to the right side of the body 1 to rotate in left/right directions centered on a vertical rotation axis for guiding the air being discharged through the right side air outlet 6B when the right side discharge vane 22B is rotated away from the body 1 in a right side direction. The left side discharge vane 22A and the right side discharge vane 22B may have rotation directions opposite to each other when the air conditioner is in operation, with other configurations and operations substantially the same except the rotation directions. Hereafter, the discharge vanes 22A and 22B will be referred to as the left side discharge vane 22A and the right side discharge vane 22B, and collectively as the side discharge vane.

The lower discharge vane 24 may rotate in up/down directions centered on a horizontal rotation axis for controlling a flow direction of the air being discharged through the air outlet 8. The lower discharge vane 24 may have the horizontal rotation axis positioned in the body 1.

The air conditioner may include a side discharge vane driving mechanism 26 for rotating the side discharge vane 22 and a lower discharge vane driving mechanism 28 for rotating the lower side discharge vane 24.

The side discharge vane driving mechanism 26 may be coupled to the body 1, and the side discharge vane 22 may be connected to the side discharge vane driving mechanism 26. The side discharge vane driving mechanism 26 may include a side discharge vane drive motor mounted on the body 1. The side discharge vane driving mechanism 26 may include a left side discharge vane driving mechanism 26A for rotating the left side discharge vane 22A and a right side discharge vane driving mechanism 26B for rotating the right side discharge vane 22B. Hereafter, the left side discharge vane driving mechanism 26A and the right side discharge vane driving mechanism 26B will be collectively referred to as the side discharge vane driving mechanism 26.

The lower discharge vane driving mechanism 28 may be coupled to the body 1, and the lower discharge vane 24 may be connected to the lower discharge vane driving mechanism 28. The lower discharge vane driving mechanism 28 may include a lower discharge vane drive motor mounted on the body 1.

A size of the illumination device 2 may be larger than the air inlet 4. The illumination device 2 may be positioned in front of the air inlet 4 to obscure the air inlet 4, so that the air inlet 4 is not visible from an outside of the air conditioner. The illumination device 2 may function as a decorative implement and/or function as a display for displaying information. The illumination device 2 may form an illumination pattern visible from an outside of the air conditioner. For example, the illumination device 2 may form a ring shaped illumination pattern, a ring shaped illumination pattern having an opened portion, a spotted illumination pattern, and other such patterns. In this case, the ring shaped illumination pattern having an opened portion may have an opened region defined by an angle smaller than 90° like a letter "C", may be formed in a semi-annular shape, and may have the angle of the opened region in a range of 180°~270°, or may include, not the ring or spotted shape, but a curved shape.

The air conditioner may include an illumination device drive mechanism 40 that causes the illumination device 2 to advance or retreat. The illumination device drive mechanism 40 may include a motor 42, and a pinion 44 and a rack 46. The illumination device drive mechanism 40 may be plural, and the plurality of illumination device drive mechanisms 40 may cause the entire illumination device 2 to advance/retreat. If the motor 42 is mounted to the body 1, the pinion 44 may be mounted to a rotation shaft of the motor 42, and the rack 46 may be mounted to the illumination device 2. If the motor 42 is mounted to the illumination device 2, the pinion 44 may be mounted to the rotation shaft of the motor 42, and the rack 46 may be mounted to the body 1. The illumination device drive mechanism 40 may move the illumination device 2 forward when the air conditioner is in operation, and may move the illumination device 2 backward when the air conditioner is turned off.

Figure 6:
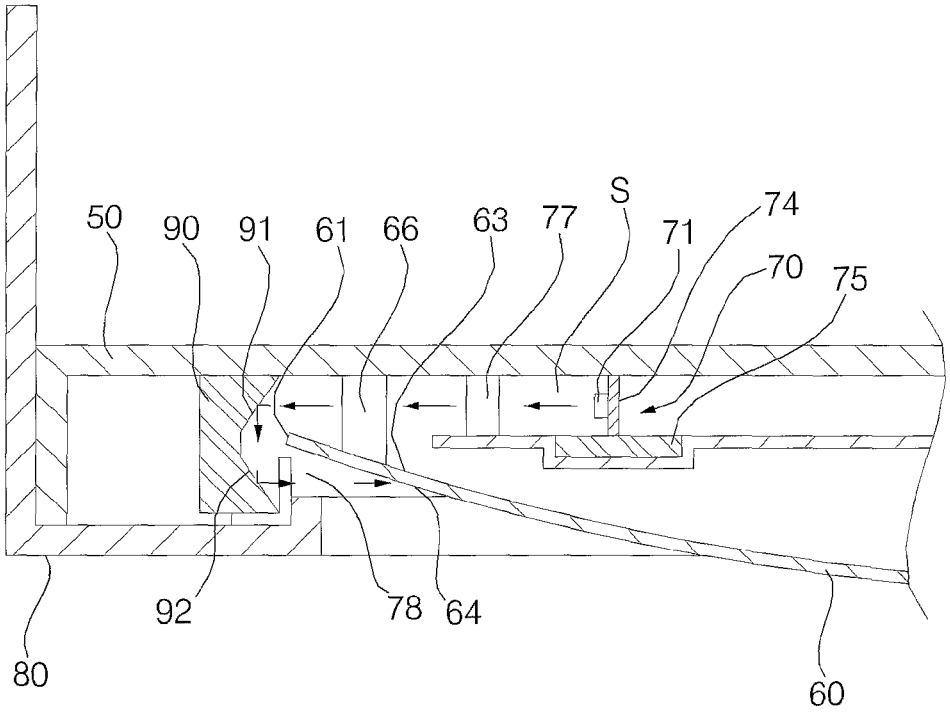
FIG. 6 is an enlarged cross sectional view of a portion of an illumination system of an air conditioner, in accordance with an embodiment as broadly described herein.

The illumination device 2 may include an illumination device base 50, a first cover 60 arranged at the base 50, a lighting device 70 positioned between the base 50 and the first cover 60 for directing a light to an outside of a space between the base 50 and the first cover 60, a second cover 80 forming a gap 78 with the first cover 60, and a reflector 90 for reflecting the light from the lighting device 60 to a front side of the first cover 60 through the gap 78. If the light is emitted from the lighting device 70, the light may be incident on the reflector 90 between the base 50 and the first cover 60, and reflected at the reflector 90 toward the gap 78. The light reflected at the reflective body 90 toward the gap 78 thus may irradiate a front side of the first cover 60 after passing through the gap 78, to form the illumination pattern on the front side of the first cover 60. The light, emitted from the lighting device 70 behind the first cover 60, does not transmit through the first cover 60, but is incident on the front side 64 of the first cover 60 (see FIG. 6).

The illumination device base 50 may be coupled to the body 1, and may form an exterior appearance of a rear side of the illumination device 2. The base 50 may be connected to the body 1 so as to be positioned on an outside of the body 1, and may be connected to the illumination device drive mechanism 40 to be moved by the illumination device drive mechanism 40. One of the motor 42 or the rack 46 may be mounted on the base 50. The base 50 may form the air inlet flow passage P together with a front side of the body 1. The base 50 may have a rear side thereof which serves as an air inlet guide surface. When in an advanced position, the base 50 may form the air inlet flow passage P with the body 1 for drawing the air through the air inlet 4 along the rear side of the base 50 and the front side of the body 1. The base 50 may have the lighting device 70 mounted thereon, and may have the first cover 60 and the second cover 80 mounted thereon.

The first cover may be visible from an outside of the illumination device 2, and may form a portion of a front side exterior appearance of the illumination device 2. The illumination device 2 may have a space formed between the first cover 60 and the base 50 to house the lighting device 70. An outer circumference 61 of the first cover 60 may be spaced apart from an inner circumference of the reflector 90. The first cover 60 may be convex in a forward direction, and in particular, the front side 64 may be convex in the forward direction. Only a portion of the front side 64 of the first cover 60 may face the reflector 90. The front side 64 of the first cover 60 may have one region facing the reflector 90, and the other region not facing the reflector 90. The front side 64 of the first cover 60 may include a first region which faces the inner circumferential surface of the reflector 90 in left/right directions, and a second region which does not face the inner circumferential surface of the reflector 90 in left/right directions. The front side 64 of the first cover 60 may include an illumination pattern forming portion on which the illumination pattern is formed, and a non-illumination pattern forming portion on which no illumination pattern is formed. The light reflected at the reflector 90 may irradiate a region (the first region) of the front side 64 of the first cover 60 facing the reflector 90, such that the illumination pattern is formed only on a region (the first region) of the front side 64 of the first cover 60 facing the reflector 90. The other region (the second region) of the front side 64 of the first cover 60 which does not face the reflector 90 may not form the illumination pattern, such that the illumination pattern formed on the front side 64 of the first cover 60 does not widely spread across the front side 64 of the first cover 60, but makes a region (the first region) facing the reflector 90 most clearly visible. A rear side 63 of the first cover 60 may face the base 50. The first cover 60 may have a concave rear side 63. The front side 64 of the first cover 60 may be convex in the forward direction so as to be irradiated with the light reflected at the reflector 90. When the lighting device 70 is turned on, the first cover 60 may have an illumination pattern forming side on which the illumination pattern is formed. The first cover 60 may be formed larger than an entire size of the lighting device 70, and may function as a shield which shades the lighting device 70 from an outside of the air conditioner. The first cover 60 may function as an illumination plate on which an illumination pattern L the illumination device 2 intends to display is expressed. The first cover 60 may be non-transparent, the light reflected at the reflector 90 may irradiate the front side 64 of the first cover 60 through the gap 78, and the light incident on the front side 64 of the first cover 60 may be expressed on the front side 64 of the first cover 60. The first cover 60 may have a first cover fastening portion 66 formed thereon for fastening the first cover 60 to the base 50 with fasteners, such as screws. The first cover fastening portion 66 may be projected from the rear side 63 of the first cover 60 toward the base 50. The first cover fastening portion 66 may include at least one boss formed on the first cover 60. The front side 64 of the first cover 60 may be a white color, and a color of the illumination pattern formed on the front side 64 of the first cover 60 may be varied with a color of the light reflected at the reflector 90.

The lighting device 70 may be arranged in a space S formed at an inner side of the reflector 90. The lighting device 70 may have a plurality of modes having at least one of sizes of the illumination pattern and/or positions of the illumination pattern formed on the front side 64 of the first cover 60 different from one another.

The lighting device 70 may have at least one light source for selectively expressing the plurality of illumination patterns. The at least one light source may emit a variety of light having different colors and light intensities, and, depending on a combination of the color and the light intensity of the light emitted by the light source, may emit a variety of color combinations and light intensity. The lighting device 70 may include a plurality of light sources 71 and 72, which may be controlled together or selectively depending on lighting modes.

Figure 5:
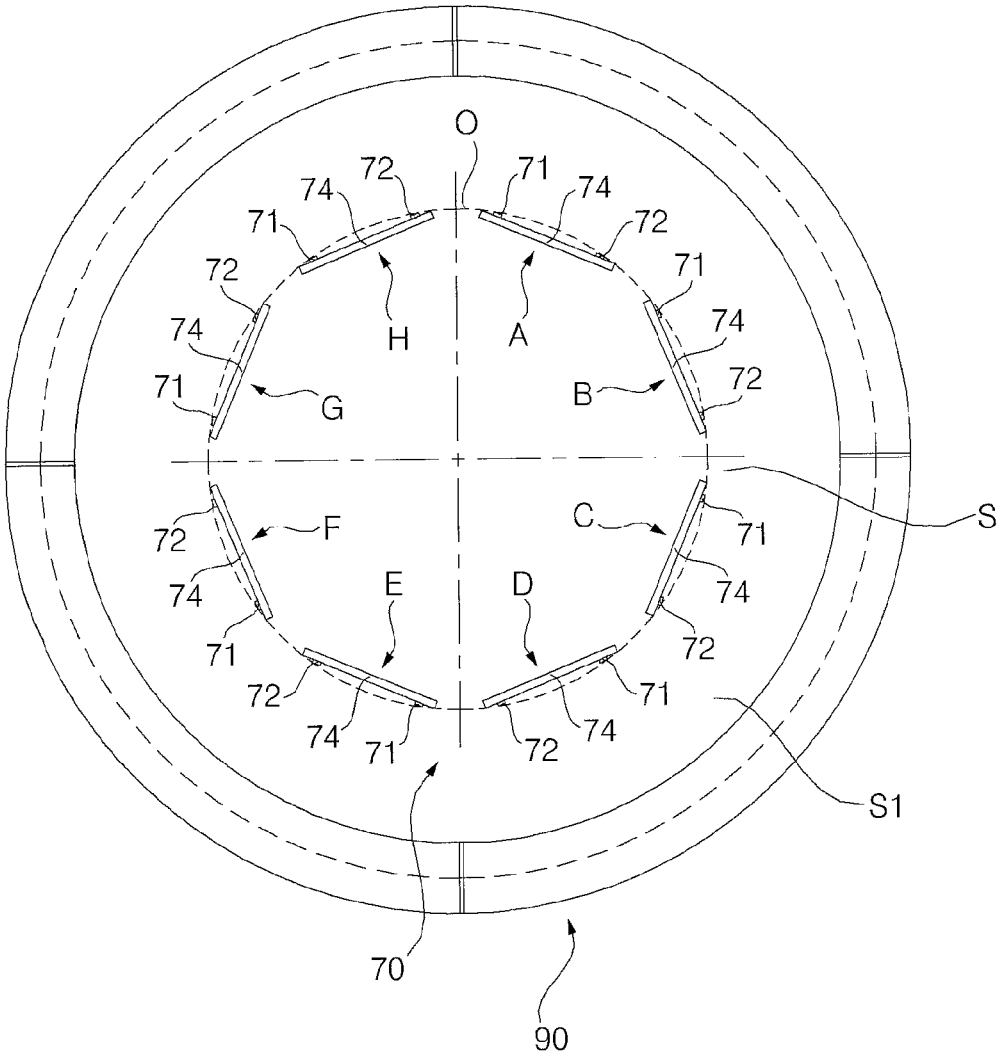
FIG. 5 is a front view of an inside of an illumination device in an air conditioner, in accordance with an embodiment as broadly described herein.

The lighting device 70 may include a circuit board 74 for mounting the light source thereto. The lighting device 70 may include a plurality of circuit boards, and the plurality of light sources 71 and 72 may be distributed to the plurality of circuit boards, as shown in FIG. 5. The plurality of circuit boards 74 may be arranged spaced from one another. The lighting device 70 may have at least two light sources mounted on each circuit board 74.

The lighting device 70 may be arranged such that the plurality of light sources 71 and 72 are positioned in succession along a circular imaginary line 0 for emitting the light radially. The lighting device 70 may form illumination patterns varied with the lighting modes on the front side 64 of the first cover 60. The lighting device 70 may include a main circuit board 75 having the plurality of circuit boards 74 mounted thereto.

The plurality of circuit boards 74 may be mounted on the main circuit board 75 spaced from one another and facing different directions. The plurality of circuit boards 74 may each have one side thereof mounted to face the inner circumference of the reflector 90, with the light sources 71 and 72 mounted on a side facing the reflector 90, such that each of the light sources 71 and 72 may emit light in a direction facing the inner circumference of the reflector 90. The lighting device 70 may be arranged such that the plurality of light sources 71 and 72 emit light radially. In certain embodiments, all of the plurality of light sources 71 and 72 are turned on altogether, and in alternative embodiments, when some of the plurality of light sources 71 and 72 are turned on, the remaining light sources 71 and 72 are turned off. The lighting device 70 may have a plurality of lighting patterns in which a number of the turned on light sources of the plurality of light sources 71 and 72 are different from one another.

Figure 7:
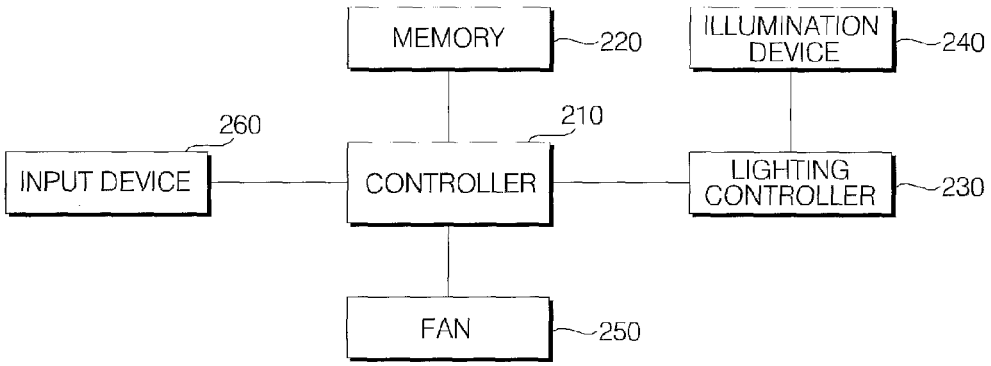
FIG. 7 is a block diagram of a control system of an air conditioner, in accordance with an embodiment as broadly described herein.

FIG. 7 is a block diagram of a control system of an air conditioner, in accordance with an embodiment.

Referring to FIG. 7, the air conditioner may include a controller 210 for performing various signal processing and operations, a memory 220 for storing programs and data in association with the controller 210, a lighting controller 230 for exchanging signals with the controller 210, an illumination device 240 for emitting light in response to a signal from the lighting controller 230, a fan 250 for blowing air, and an input device 260.

The input device 260 may receive an input for setting operation, the fan 250 may blow air to condition a room according to the set operation, the illumination device 240 may include a plurality of light sources arranged to illuminate a region defined by a closed curve, with a case housing the fan 250 therein and having an air outlet formed therein for discharging the air blown by the fan 250 in a direction of the closed curve, and a lighting controller 230 generating an indicator together with the illumination device 240 corresponding to an airflow direction.

The controller 210 may perform various functions for the air conditioner, and may run or perform various software programs and/or sets of commands stored in the memory 220 for processing data. The controller 210 may process a signal based on information stored in the memory 220.

For example, the controller 210 may perform a program stored in the memory 220 to indicate, for example, on a display or the like, a room temperature, a starting temperature, a power saving temperature, whether a scheduled operation is set or not, a type of operation currently performed, or transmission of light pattern information to the lighting controller 230 depending on the type or state of the operation.

The controller 210 may retrieve the light pattern information from the memory 220. The controller 210 may receive information input at the input device 260 and perform an operation mode matched to the signal input by the user. The controller 210 may control a speed of the fan 250 based on the input signal. The controller 210 may control the lighting controller 230 based on the operation mode. The input device 260 may be a wired or wireless remote controller. If the input device 260 is a remote controller, the air conditioner may further include a communication device for connecting the input device 260 to the controller 210.

The controller 210 may receive the light pattern information from the memory 220. The controller 210 may determine the light pattern information matched to the operation mode input by the user. For an example, if an input for changing a wind direction is received, the controller 210 may retrieve the light pattern information matched thereto from the memory 220 and transmit the same to the lighting controller 230.

The controller 210 may determine the input received at the input device 260 and perform the input accordingly. For an example, if the input device 260 receives an input for room cooling, the controller 210 may perform room cooling operation, and, if dehumidification, the controller 210 may perform a dehumidification operation. The controller 210 may determine a light pattern matched to the operation input from the light pattern information.

Though the controller 210 may control the vane(s) for determining one or more of the plurality of air outlets for discharging the air, however, methods for discharging the air through a particular air outlet is not limited to this.

The controller 210 may transmit information on the light pattern matched to the operation input to the lighting controller 230. The lighting controller 230 may receive this information and determine a mode of the light pattern the illumination device 240 is to emit based on the received information.

In order to indicate that the input device 260 has received the operation input, the lighting controller 230 may change the light pattern generated by the illumination device 240. The lighting controller 230 may control the illumination device 240 to emit light based on the light pattern information.

The lighting controller 230 may generate, with the illumination device 240, an indicator corresponding to a direction of an air flow being discharged through the air outlet(s). For example, the lighting controller 230 may control a light source adjacent to the air outlet through which the air is being currently discharged to emit light.

The lighting controller 230 may control a number of emitting light sources adjacent to the outlet through which the air is being discharged to increase slowly. The lighting controller 230 may change a color of the light source arranged at regions except the region adjacent to the outlet through which the air is being discharged.

The lighting controller 230 may slowly reduce the number of emitting light sources arranged at a region except the region adjacent to the outlet through which the air is being discharged. The lighting controller 230 may control the illumination device 240 to output an operation indicating light pattern matched to a set operation. If a signal for changing a direction of air discharge is received at the input device 260, the lighting controller 230 may change the light pattern to a direction indicating light pattern to express a change in the direction the air is being discharged.

The lighting controller 230 may output a direction indicating light pattern which indicates a direction in which the air is being discharged and a direction which is not being discharged, causing the illumination device 240 to change according to a fixed pattern or predetermined pattern for a fixed time period or predetermined period of time. If the fixed time period has elapsed after display of the direction indicating light pattern, the lighting controller 230 may change the light pattern to the operation indicating light pattern.

In order to indicate that the input device 260 has received an operation input, the lighting controller 230 may change the light pattern and may control the illumination device 240 to emit light based on the light pattern information.

The illumination device 240 may further include a reflector that forms a closed curve. The illumination device 240 may include a plurality of light sources arranged in the closed curve. The plurality of light sources may emit the light toward the reflector so as to illuminate a region defined within the closed curve.

The memory 220 may include a fast random access memory. The memory 220 may include, but is not limited to, at least one of a magnetic disc storage, a flash memory, or other non-volatile memory, such as a non-volatile solid state memory, readable storage and the like.

For an example, the memory 220 may include, but is not limited to, EEP-ROM (Electronically Erasable and Programmable Read Only Memory). The EEP-ROM allows writing and erasing of information by the controller 210 when the controller 210 is in operation. The EEP-ROM may be a memory device which may maintain the information stored therein without being erased even if power supply to the air conditioner is turned off cutting off the power supply thereto.

The memory 220 may store the light pattern information to be emitted by the illumination device 240. For an example, the memory 220 may store the light pattern information in which the plurality of light sources emit light according to a set operation. If the controller 210 requests, the memory 220 may provide the light pattern information to the controller 210.

The light pattern information may be information related to a plurality of light patterns matched to a plurality of operations of the air conditioner. If there is an input for controlling a wind direction of the air conditioner, the light pattern information may include a method for indicating the wind direction using light emitted by the illumination device 240. For example, the light pattern information may be related to methods for operating a lighting device to indicate the operation and the wind direction of the air conditioner with particular modes of light patterns and colors.

The air conditioner may further include an output device, including, for example, a speaker for emitting a sound, a display for displaying visual output, and the like. The input device 260 may include means for receiving an external input, such as a physical button, a dial, a slider switch, a click wheel, a touch screen, and other such devices.

The output device may include, but is not limited to, at least one of an LPD (light emitting polymer display), LCD (liquid crystal display), TFT-LCD (thin film transistor-liquid crystal display), organic light-emitting diode, flexible display, or 3D display.

The output device may display information required for conditioning the air. For an example, the output device may display operation modes, such as room cooling, room heating, dehumidification, air cleaning, and other such information.

Depending on embodiments, the output device may include a touch sensing touch screen. The touch sensing touch screen may display a visual output to the user, and may receive an input from the user based on a tactile contact.

The visual output may include a graphic, a text, an icon, a video, and/or a combination thereof. Depending on embodiments, some or all of the visual output may be matched to user interface entities.

The touch sensing touch screen may detect a contact thereto, and may convert the detected contact to match one or more of the user interface entities displayed on the touch screen.

The lighting controller 230 may transmit/receive signals to/from the controller 210. The lighting controller 230 may receive the light pattern information from the controller 210. The lighting controller 230 may receive the signal from the controller 210 for controlling degrees of changes of the light patterns generated by the plurality of light sources.

The illumination device 240 may include a plurality of light sources. The illumination device 240 may control the light sources to emit light in response to a signal from the lighting controller 230. The lighting controller 230 may control the plurality of light sources to emit light in succession, for example, in an order of adjacency.

The lighting controller 230 may control the plurality of light sources of the illumination device 240 to gradually change a quantity of light in succession in an order of adjacency. According to operation input received at the input device 260, the lighting controller 230 may control the light pattern of the illumination device 240 different. The lighting controller 230 may make the plurality of light sources to be turned on/off in succession according to the wind direction of the air conditioner.

The illumination device 240 may cause at least a region of an imaginary closed curve to illuminate. The lighting device 240 may include a reflector which forms the closed curve. The illumination device 240 may have a mode in which the plurality of light sources arranged in the closed curve and direct light to the reflector 90. The closed curve may be, for example, a triangle, a square, a pentagon, a hexagon, a circle, an ellipse, or other such closed curve, but embodiments are not limited thereto.

FIGS. 8 through 11 illustrate operation of an air conditioner, in accordance with embodiments as broadly described herein.

Figure 8:
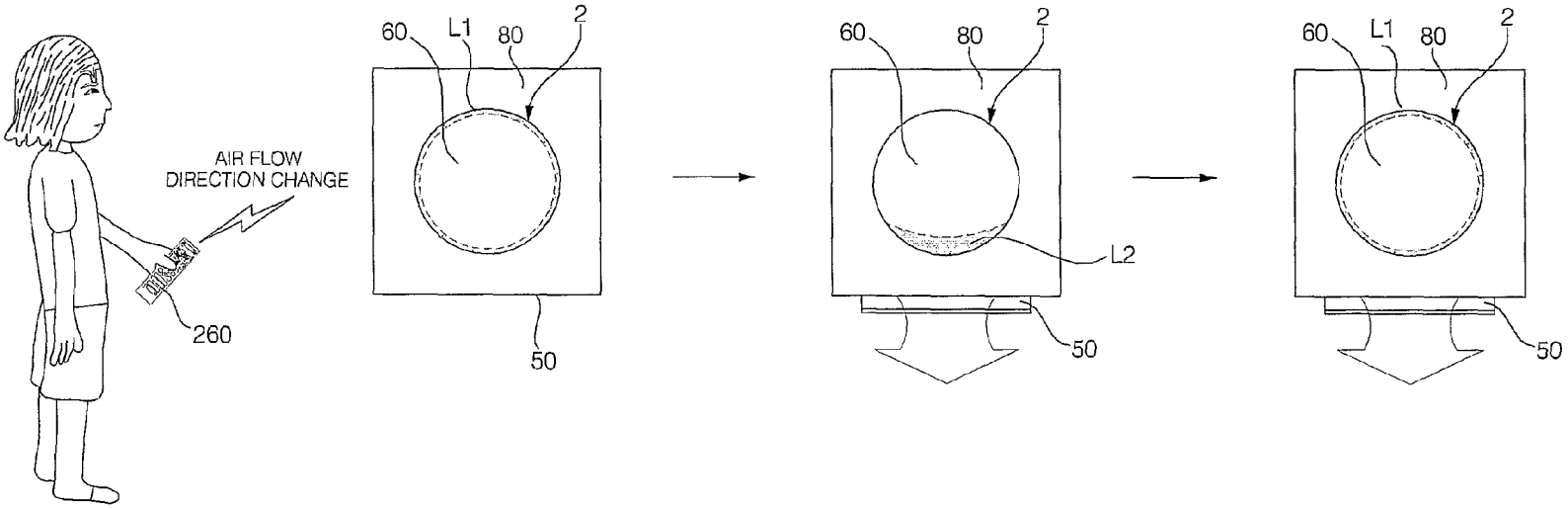
FIGS. 8 through 11 are schematic views illustrating operation of an air conditioner, in accordance with an embodiment as broadly described herein.

As shown in FIG. 8, the air conditioner may receive an operation mode from the user. The air conditioner may receive various inputs from the user via the input device 260. For example, the air conditioner may receive various user inputs via a remote controller serving as the input device 260.

Referring to FIG. 8, the illumination device 2 may display a light pattern L1 to match the user set operation. In another embodiment, the illumination device 2 may provide illumination having an esthetic effect.

If a new input is received via the input device 260, the air conditioner may display a direction indicating light pattern L2, notifying the user that the input has been received by the input device 260. For example, if the input device 260 receives an input for changing the wind direction, the illumination device 2 may change the light pattern displayed from the light pattern L1 to the direction indicating light pattern L2 that indicates the wind direction.

The direction indicating light pattern may change according to a fixed pattern for a fixed time period, to indicate a direction in which the air is being discharged and a direction in which the air is not being discharged.

Once the illumination device 2 has displayed the direction indicating light pattern L2 to indicate the change in wind direction for a fixed time period, the air conditioner may return to the prior light pattern L1.

Figure 9:
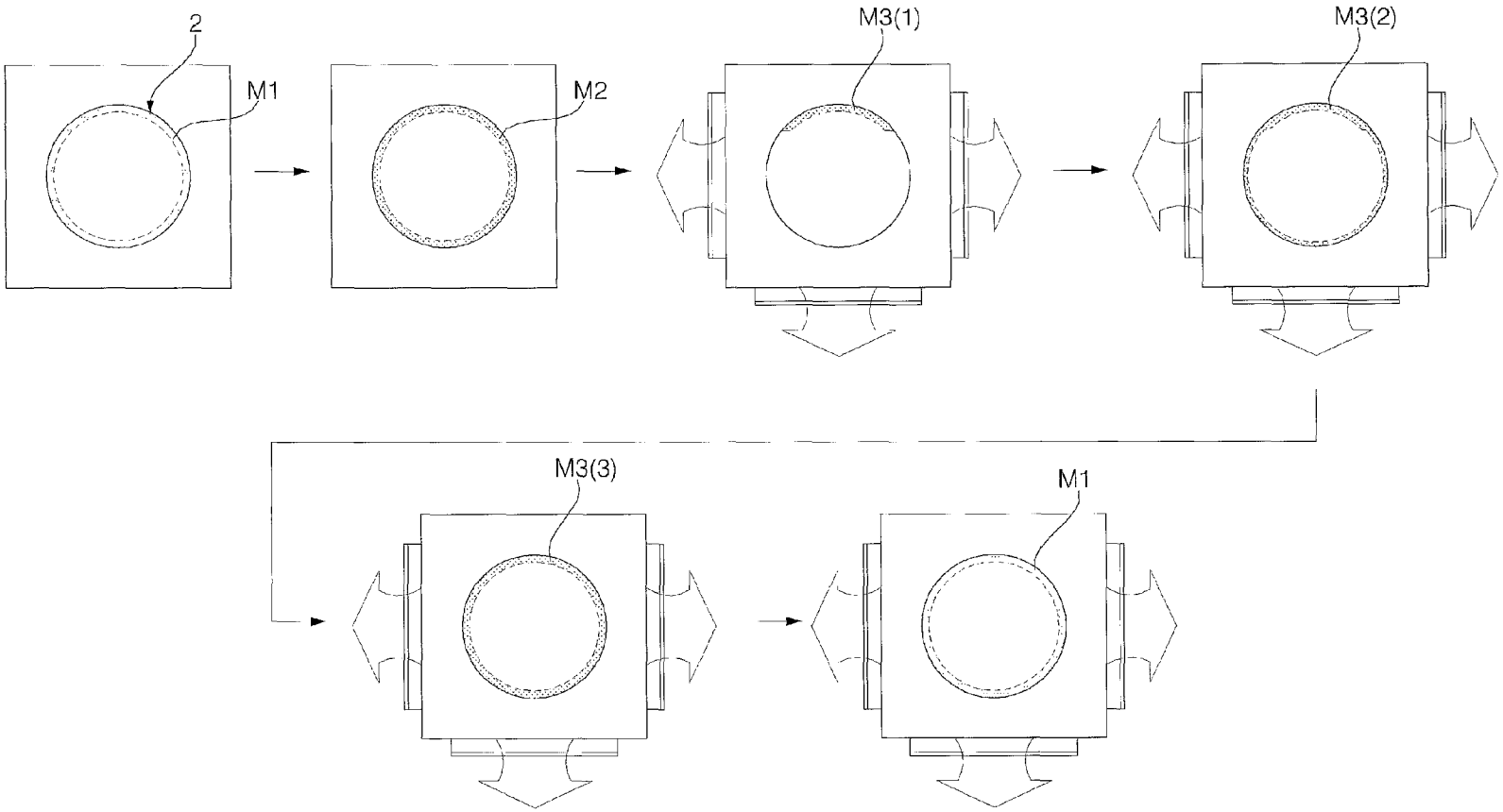
Figure 10:
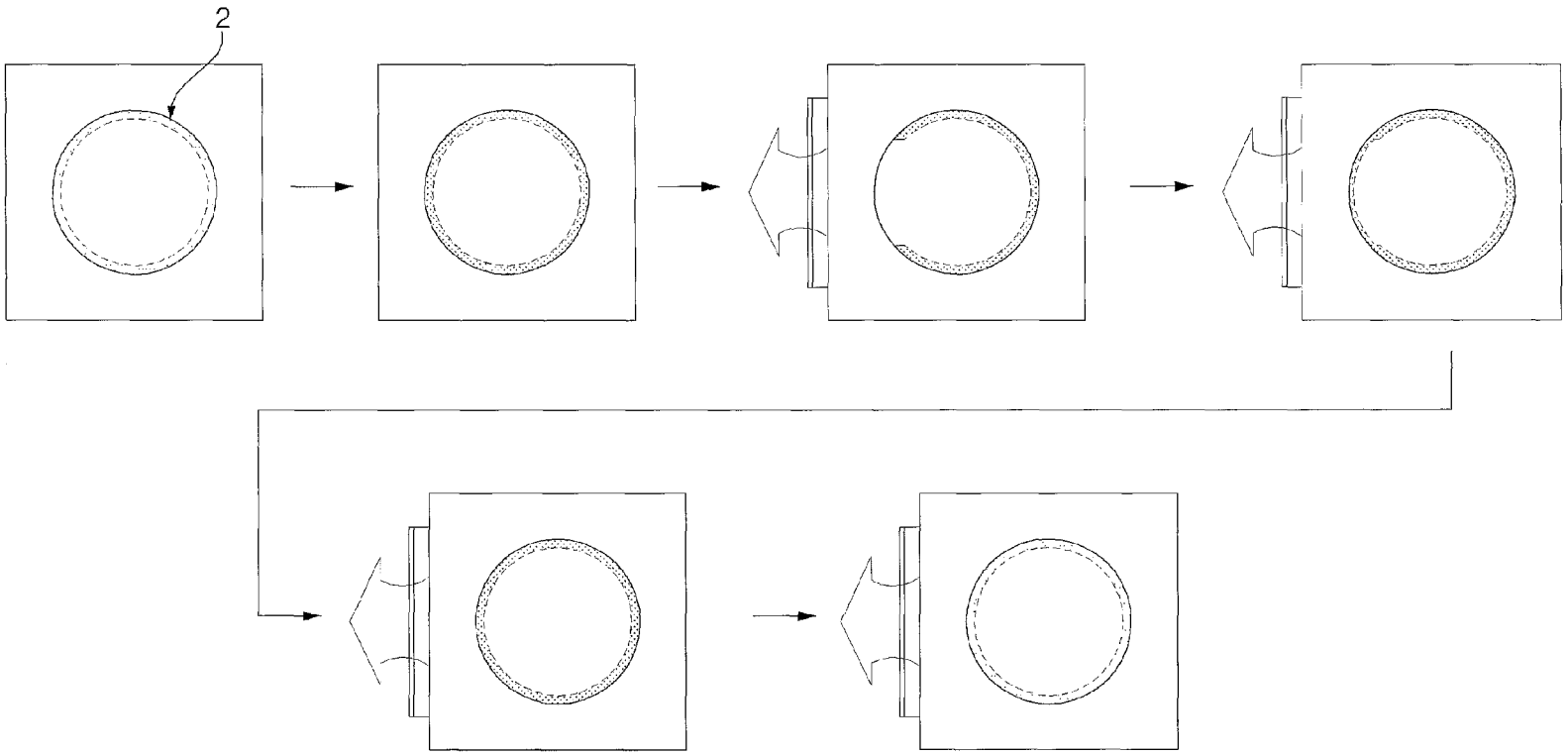

Referring to FIGS. 9 and 10, the air conditioner, in accordance with embodiments as broadly described herein, of the present invention may include the illumination device 2 which indicates the operation being currently performed.

The illumination device 2 may display an operation light pattern M1 matched to the operation being currently performed, or a light pattern preset by the user sets. If an input is received at the input device 260, the illumination device 2 may display a different light pattern M2 matched to the input.

For example, the air conditioner may indicate a type of operation being currently performed using the illumination device 2. For example, if the input changes the wind direction, the air conditioner may indicate the type of operation proceeding presently or a basic light pattern designated by the user with the illumination device 2. The illumination device 2 may display an appropriate direction indicating light pattern which indicates the direction of wind after displaying the basic light pattern.

In order to indicate that the input device 260 has received a particular operation input, the air conditioner may change the light pattern generated by the illumination device 2. For example, if the input device receives an input for changing the wind direction during a room cooling operation, the air conditioner may display a light pattern having a color matched to the room cooling operation. The color matched to the room cooling operation may be a color from, for example, a cold group, for an example, a blue color group.

If the input device receives an input for changing the wind direction, the air conditioner may change the light pattern the illumination device 2 outputs from a light pattern having a color which indicates a particular operation to a direction indicating light pattern which indicates the wind direction.

The illumination device 2 may display the direction indicating light pattern varying with time. For example, after displaying a light pattern matched to the operation, the illumination device 2 may illuminate a portion M3(1) matched to a direction that excludes the air discharge direction, and may increase a light quantity M3(2) and M3(3) matched to the air discharge direction slowly as time passes.

The illumination device 2 may flash the air discharge direction for a preset number of times. For example, any one of the light patterns M3(1), M3(2), and M3(3) may be repeated for a plurality of times. The illumination device 2 may be turned on/off while gradually controlling the light quantity as time passes. After flashing a portion matched to the air discharge direction for a preset time period or a fixed number of times, the illumination device may output a prior light pattern M1 again.

FIG. 9 illustrates various light patterns generated by the illumination device 2 when the air conditioner discharges air through a lower side and both lateral sides thereof. The illumination device 2 may display a basic light pattern M1 matched to an operation state, and may then illuminate selected portions over time, as appropriate.

The illumination device 2 may make colors of the basic light pattern and the direction indicating light pattern the same, and may illuminate a portion matched to the air discharge direction. The illumination device 2 may flash a portion matched to the air discharge direction. The illumination device 2 may gradually increase a light quantity of a portion matched to the air discharge direction, with the light quantities of these portions matched to the two lateral sides and the lower side of the air conditioner M3(1), M3(2) and M3(3) decreased after being increased, respectively.

In certain embodiments, the air conditioner may discharge the air in a left direction, as shown in FIG. 10.

The air conditioner may display a basic light pattern matched to an operation state. For an example, when a room cooling is performed, the air conditioner may display the basic light pattern in, for example, a color from the blue group. In the embodiments shown in FIGS. 9 and 10, though the basic light patterns are circular, the basic light pattern is not limited to these, and various other embodiments including other closed curve modes may be available.

The illumination device 2 may illuminate a portion thereof adjacent to a left side of the air conditioner through which the air conditioner discharges the air. The illumination device 2 may flash the portion adjacent to the left side of the air conditioner through which the air conditioner discharges the air. The illumination device 2 may gradually increase or decrease the light quantity of the portion adjacent to the left side of the air conditioner through which the air conditioner discharges the air as time passes.

After flashing a portion matched to the air discharge direction for a fixed time period or a fixed number of times, the illumination device may output a prior light pattern.

Figure 11:
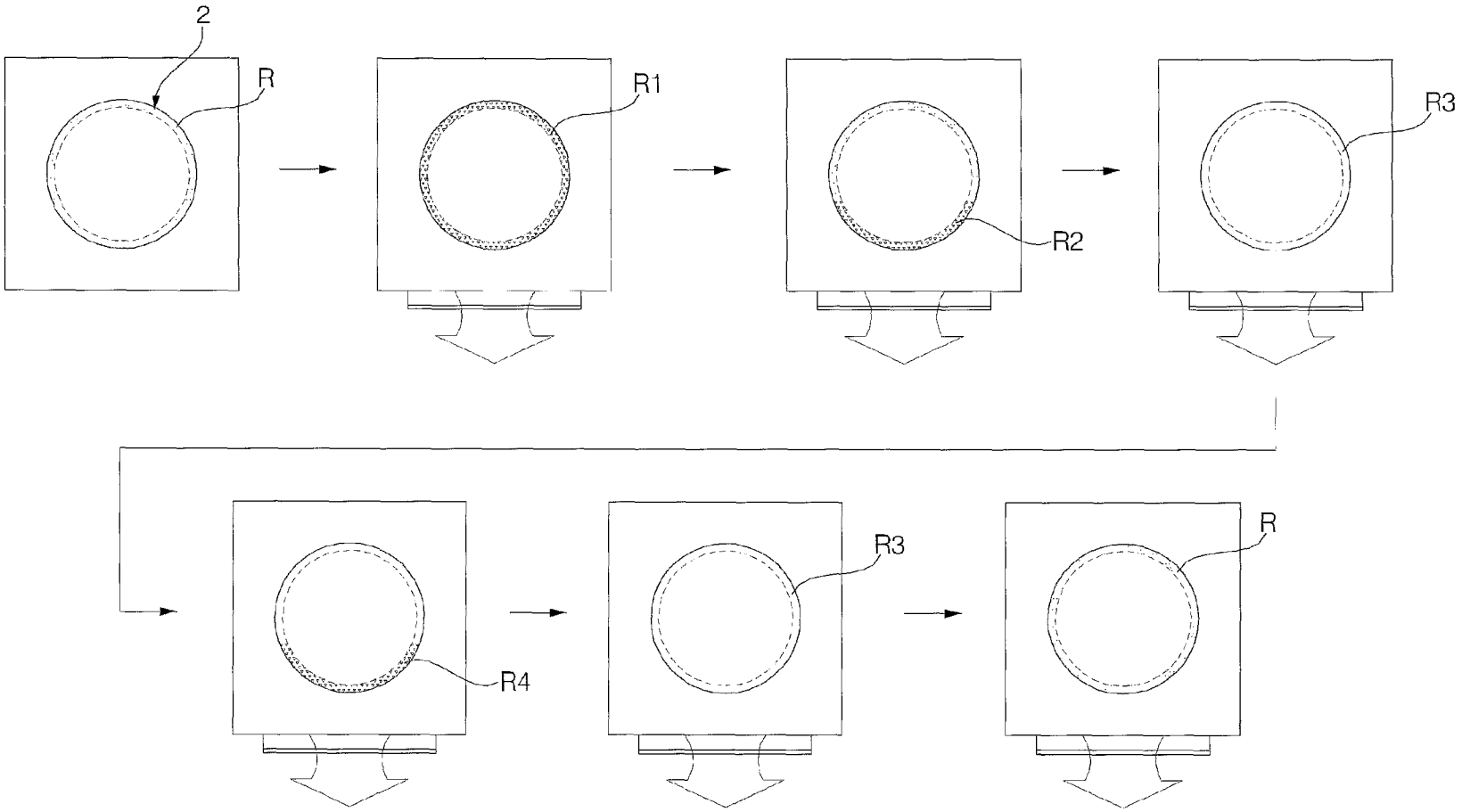

Referring to FIG. 11, the air conditioner may display a light pattern R1 matched to the operation state, or based on a user's input. If a room heating operation is performed, a light pattern of, but not limited to, a red color group may be displayed. For an example, if the input device 260 receives an input for controlling an air flow direction of the air conditioner, the illumination device 2 may change the light pattern to a light pattern matched to the present operation state.

The illumination device 2 may change a color or a light quantity of light a portion excluding a portion R2 matched to the air discharge direction. The illumination device 2 may then change the color or the light quantity of the light at a portion R2 matched to the air discharge direction of the air conditioner. The illumination device may change a color or a light quantity of light at a portion matched to the air discharge direction of the air conditioner and a portion not matched to the air discharge direction of the air conditioner R3, R4. For example, the illumination device 2 may go from illumination pattern R3 to R4 and back to R3 in succession repeatedly for indicating the air discharged direction of the air conditioner.

The illumination device 2 may increase the light quantity of the portion matched to the air discharge direction of the air conditioner. The illumination device 2 may flash the portion matched to the air discharge direction of the air conditioner. The illumination device 2 may change the color of the portion matched to the air discharge direction of the air conditioner a preset number of times. The illumination device 2 may control the color of the light emitted by the illumination device 2 to continuously change.

If the illumination device 2 has the direction indicating light pattern displayed for a preset number of times, or a preset time period, for indicating an air flow direction, the illumination device 2 may display a prior light pattern R again.

Figure 12:
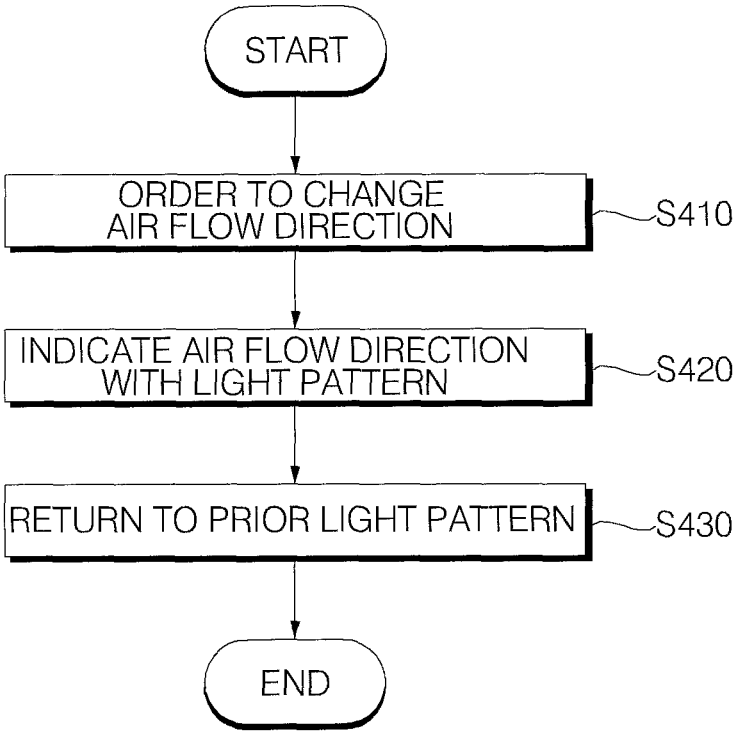
FIG. 12 is a flow chart of a method for controlling an air conditioner, in accordance with an embodiment as broadly described herein.

FIG. 12 is a flow chart of a method for controlling an air conditioner, in accordance with an embodiment as broadly described herein.

Referring to FIG. 12, the method may include receiving an order for changing an air flow direction (S410), indicating a direction of the air flow with a light pattern (S420) and displaying a prior light pattern again (S430).

The air conditioner may have an input device for receiving the order for changing the air flow direction (S410). For example, the air conditioner may discharge the air in a lateral direction, or up/down directions, but embodiments are not limited to this.

The air conditioner may indicate an air discharge direction with a light pattern output by the illumination device (S420). The illumination device may display a light pattern illuminating at least a region of a closed curve. The air conditioner may discharge the air in a direction outside of the closed curve through a plurality of air outlets.

The illumination device may indicate the air discharge direction with the light pattern illuminating a region of the closed curve. The illumination device may indicate a portion matched to the air discharge direction and a portion not matched to the air discharge direction with, for example, colors or light quantities of the light patterns, or with flashes.

The illumination device may display the direction indicating light pattern, which indicates the air discharge direction, a preset number of times or for a preset time period, and may then display a prior illumination pattern again (S430).

Even though the various elements of the exemplary embodiments are described as being coupled to a unit or operated in a coupled state, embodiments are not limited thereto. Though all of the elements of the configuration may be embodied by independent hardware, some or all elements of the configuration may be selectively combined to embody computer programs each having a program module for performing functions of a combined part or an overall combination thereof in one or a plurality of hardware elements.

A plurality of codes or code segments of a computer program may be inferred by a person skilled in this field of art. By storing the computer program in a computer readable media which the computer may read, and after being read, run by a computer, the embodiments may be realized. In the computer readable media which may store the computer program, there may be magnetic recording media, optical recording media, carrier wave media, and so on.

The words "include", "constitute" or "have" described above may indicate that an element related thereto exists therein, but should not be interpreted to mean that the words exclude other elements, but rather, may include additional elements.

All words and terms including technical or scientific terms have a meaning generally understood by a person skilled in this field of art as far as the words and terms are not defined differently.

Words and terms used generally like ones defined in a dictionary will not be interpreted as an ideal or very official meaning as far as the words or terms are interpreted and defined to meet description disclosed, presently.

The foregoing description is merely an exemplary description of technical aspects of embodiments as broadly described herein, and a person skilled in this field of art may make various modifications and variations without departing from the scope as broadly described herein.

It will be apparent to those skilled in the art that embodiments are not limited to the above-described embodiment(s) and drawings, and various changes or modifications may be made therein without departing from the scope and the technical sprit as broadly described herein.

In a typical air conditioner, an illumination system or a display mounted on the air conditioner may display an operation state of the air conditioner using, for example, a character, and/or may be used for decorative illumination regardless of the operation state.

An air conditioner as embodied and broadly described herein may include an illumination system which provides an illumination pattern indicating an air flow direction of air being discharged from the air conditioner.

An air conditioner, as embodied and broadly described herein, may include an input unit for receiving an input required for setting operation, a fan unit for blowing air according to the operation set thus, an illumination system for illuminating a region of a closed curve, a case having the fan unit provided therein and an air outlet formed therein for discharging the air to an outside direction of the closed curve, and a lighting control unit for indicating a direction of the air being discharged through the air outlet with the illumination system.

In response to an input received at the input unit, an air conditioner as embodied and broadly described herein may provide an indication of the input using the illumination unit so that the user may determine whether or not the input was entered properly.

By displaying a direction indicating light pattern indicating that an air discharge direction has been changed, and returning to a prior light pattern when a preset time period has elapsed, with the illumination unit, an air conditioner as embodied and broadly described herein may provide uninterrupted light patterns, reducing user eye fatigue, enhancing user comfort and convenience.

In an air conditioner as embodied and broadly described herein, the illumination unit illuminates at least a region defined by a closed curve perpendicular to an air discharged direction, and thus the air discharge direction may be visually identified.

In an air conditioner as embodied and broadly described herein, the air discharge direction and a direction in which the air is not discharged may be indicated by a light pattern that is varied over time, air flow direction may be intuitively determined.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

a case having a plurality of air outlets formed in at least two of a left side, a right side, and a lower side of the case to discharge air in directions different from one another, and an air inlet formed in a front side of the case;

an input device configured to receive an input for selecting an operation;

a fan provided in the case, wherein the fan blows the air according to the selected operation so as to discharge the air through at least one air outlet of the plurality of air outlets;

an illumination system positioned at a front of the case, wherein the illumination system selectively illuminates a region defined within a closed curve; and a lighting controller configured to control the illumination system to generate an indicator indicating a direction of the air being discharged through the at least one air outlet.

2. The air conditioner of claim 1, wherein the illumination system includes a plurality of light sources, and wherein the lighting controller is configured to activate at least one of the plurality of light sources corresponding to each of the plurality of air outlets through which the air is being discharged.

3. The air conditioner of claim 2, wherein the lighting controller is configured to control the illumination system to decrease a quantity of light emitted by at least one of the plurality of light sources arranged at a first region, and wherein the first region excludes a second region corresponding to each of the plurality of air outlets through which the air is being discharged.

4. The air conditioner of claim 1, wherein the lighting controller is configured to control the illumination system to gradually increase a quantity of light emitted to a region adjacent to each of the plurality of air outlets through which the air is being discharged.

5. The air conditioner of claim 4, wherein the lighting controller is configured to control the illumination system to decrease the quantity of light to a minimum level before gradually increasing the quantity of light.

6. The air conditioner of claim 1, wherein the lighting controller is configured to control the illumination system to change a color of light emitted to a first region, and wherein the first region excludes a second region which is adjacent to each of the plurality of air outlets through which the air is being discharged.

7. The air conditioner of claim 1, wherein the lighting controller is configured to control the illumination system to output an operation light pattern corresponding to the selected operation, or to a selected light pattern corresponding to an external input received at the input device.

8. The air conditioner of claim 1, wherein, in response to a signal received at the input device for changing an air discharge direction, the lighting controller is configured to change the current light pattern output by the illumination system to a direction indicating light pattern corresponding to the changed air discharge direction.

9. The air conditioner of claim 8, wherein the lighting controller is configured to change the direction indicating light pattern according to a fixed pattern for a predetermined period of time so as to indicate the direction in which the air is discharged and a direction in which the air is not discharged.

10. The air conditioner of claim 9, wherein the lighting controller is configured to control the illumination system to output the light pattern only in the direction corresponding to the direction in which the air is discharged.

11. The air conditioner of claim 8, wherein the lighting controller is configured to control the illumination system to display the operation light pattern again after the predetermined period of time has elapsed.

12. The air conditioner of claim 1, wherein the illumination system includes a reflector that defines the closed curve, and wherein a plurality of light sources is arranged in the closed curve defined by the reflector such that light emitted by the plurality of light sources is directed toward the reflector.

13. The air conditioner of claim 12, wherein when the air is discharged through the at least one air outlet of the plurality of air outlets, the lighting controller is configured to control the plurality of light sources such that a quantity of light emitted by one of the plurality of light sources adjacent to the at least one air outlet of the plurality of air outlets through which the air is discharged is first brought to a minimum level and then is gradually increased.

14. An air conditioner, comprising:

a rear case having a plurality of air outlets formed in at least two of a left side, a right side, and a lower side of the rear case to discharge air in directions different from one another;

a front case having an air inlet formed in a front side of the front case and movably coupled to the rear case, wherein, in a first position, the front case is coupled to and spaced apart from the rear case so as to form the plurality of air outlets therebetween, and in a second position, the front case is coupled to and positioned against the rear case such that the plurality of outlets is closed;

a first driving device operably coupled between the front and rear cases so as to move the front case relative to the rear case;

a fan provided in a space formed between the front case and the rear case, and configured to draw the air into the rear case through the air inlet formed in the front case and to discharge the air through the plurality of air outlets formed by the front and rear cases in the first position;

an illumination device positioned at a front of the front case and configured to output a light pattern to an outside of the air conditioner; and a lighting controller configured to control the illumination device to output a predetermined light pattern based on at least one of an operation state of the air conditioner, a predetermined light pattern setting, or an air discharge direction.

15. The air conditioner of claim 14, wherein the first driving device includes:

a rack provided on one of the front case or the rear case;

a motor and a pinion coupled to a shaft of the motor provided on the other of the front case or the rear case, wherein the pinion is configured to engage the rack and to move the front case relative to the rear case in response to a driving force provided by the motor.

16. The air conditioner of claim 15, further including:

a plurality of vanes rotatably coupled to the rear case, at positions corresponding to the plurality of air outlets; and a second driving device configured to selectively rotate the plurality of vanes so as to selectively open and close the plurality of air outlets based on an air discharge direction corresponding to a selected mode of operation of the air conditioner.

17. The air conditioner of claim 15, wherein the illumination device includes:

a base;

a cover coupled to a front side of the base;

a reflector installed on the base, between the base and the cover; and a plurality of light sources arranged in an area defined by the reflector such that light emitted by the plurality of light sources is directed toward the reflector and reflected out through a gap formed between the base and the cover.

18. The air conditioner of claim 17, wherein the cover includes:

a first cover coupled within the area defined by the reflector, that covers the plurality of light sources; and a second cover coupled to the base at a position corresponding to a periphery of the first cover and extending around an outside of the base to be coupled to the front case of the air conditioner, and wherein the gap is formed between an end of the first cover corresponding to the periphery of the first cover, the periphery of the first cover, and the reflector.

19. The air conditioner of claim 17, wherein the lighting controller is configured to activate one or more of the plurality of light sources corresponding to one or more of the plurality of air outlets through which the air is being discharged so as to output a light pattern indicating an air discharge direction.

20. The air conditioner of claim 14, wherein the lighting controller is configured to control the illumination device to output the predetermined light pattern, to change the light pattern to an air discharge direction pattern in response to an operation of the air conditioner in which the air is discharged through one or more of the plurality of air outlets, and to resume output of the predetermined light pattern after a predetermined amount of time has elapsed while outputting the air discharge direction pattern.

* * * * *